US005646465A

United States Patent [19]

Paweletz

[11] Patent Number: 5,646,465

[45] Date of Patent: Jul. 8, 1997

[54] DRIVE FOR A SHAFTLESS SPINNING ROTOR OF AN OPEN-END SPINNING KMACHINE

[75] Inventor: Anton Paweletz, Stuttgart, Germany

[73] Assignee: SKF Textilmaschien-Komponenten GmbH, Stuttgart, Germany

[21] Appl. No.: 407,770

[22] Filed: Mar. 21, 1995

[30] Foreign Application Priority Data

Mar. 30, 1994 [DE] Germany ..... 44 11 032.4

[51] Int. Cl.[6] ..... H02K 7/09

[52] U.S. Cl. ..... 310/90.5; 310/258; 310/179; 57/100; 57/58.3; 57/89

[58] Field of Search ..... 310/90.5, 258, 310/179; 57/100, 58, 89

[56] References Cited

U.S. PATENT DOCUMENTS

| | | | |
|---|---|---|---|
| 3,383,534 | 5/1968 | Ebbs | 310/257 |
| 3,459,982 | 8/1969 | Cartier | 310/164 |
| 4,016,713 | 4/1977 | Lauger et al. | 57/100 |
| 4,070,813 | 1/1978 | Quandt et al. | 57/58 |
| 4,117,359 | 9/1978 | Wehde | 310/67 R |
| 4,435,662 | 3/1984 | Tawse | 310/168 |
| 4,446,392 | 5/1984 | Jaescke | 310/105 |
| 4,543,780 | 10/1985 | Muller et al. | 57/406 |
| 4,714,853 | 12/1987 | Palmero et al. | 310/257 |
| 5,034,639 | 7/1991 | Huss et al. | 310/60 A |
| 5,084,642 | 1/1992 | Katsuzawa et al. | 310/54 |
| 5,127,218 | 7/1992 | SAchiesser et al. | 57/100 |
| 5,331,238 | 7/1994 | Johnsen | 310/58 |
| 5,404,704 | 4/1995 | Menegatto | 57/100 |

FOREIGN PATENT DOCUMENTS

| | | |
|---|---|---|
| 4104250A1 | 2/1991 | Germany . |
| WO92/01096 | 1/1992 | WIPO . |

*Primary Examiner*—Thomas M. Dougherty
*Assistant Examiner*—Elvin G. Enad
*Attorney, Agent, or Firm*—Shefte, Pinckney & Sawyer

[57] ABSTRACT

In a shaftless spinning rotor assembly wherein the spinning rotor is the rotor of an axial field motor, an improved transfer of power and improved running properties are attained by forming the stator windings in channels which extend substantially radially in the stator core and are enclosed over at least a portion of their length by magnetically conducting material. As compared with known gap windings, the windings can be placed in multiple layers while at the same time avoiding marked graduations in permeance and in the specific current density so that eddy currents in the rotor can in turn be reduced and rotor heating remains within reasonable limits. The stator is preferably formed of multiple component parts which allows optimized selections of materials.

14 Claims, 5 Drawing Sheets

DRIVE FOR A SHAFTLESS SPINNING ROTOR OF AN OPEN-END SPINNING KMACHINE

FIELD OF THE INVENTION

The present invention relates to a single-motor drive for a shaftless spinning rotor of an open-end spinning machine, i.e., a rotor that is not mechanically guided radially.

BACKGROUND OF THE INVENTION

As development of rotor spinning machines progresses, the goal is not only to improve the quality of the yarns produced, but above all to increase production capacity. A key factor in increasing production capacity is the rotary speed of the spinning rotor. For this reason, varied kinds of drives and bearings for spinning rotors have been developed, in order to reach rotary speeds of markedly over 100,000 rpm. Reducing the rotor diameter and mass and lowering friction losses enables not only greater rotary speed but also reduced energy consumption when driven.

In this respect, a shaftless spinning rotor, which is embodied as the rotor of an axial field motor, can be considered especially advantageous by providing a combined magnetic and gas bearing which assures relatively low friction losses.

An axial field motor with a combined magnet/gas bearing is disclosed in WO 92/01096, wherein the spinning rotor has a bearing face remote from the rotor opening in opposed facing relation to a bearing face the stator of the motor at a spacing defining an air gap between the two bearing faces which thereby form the combined magnetic/gas bearing. The axial field motor has means associated with both the stator and the rotor for conducting the magnetic flux of magnetic fields for driving and guiding the rotor. The stator is annular in shape and has a segmental winding, disposed symmetrically to the rotational axis of the rotor, for generating the surrounding driving magnetic field. This winding is embodied as a so-called gap winding, i.e., wrapped around the unslotted stator core, so that it extends in the region of the bearing face within the gap between the stator core and the rotor base. This kind of gap winding necessitates a limitation to a certain winding geometry, because the non-magnetic properties of copper dictate keeping a relatively small width in the gap between the magnetically conductive materials of the stator core and of the rotor base in order to limit the magnetic reluctance. In such a gap winding, only one layer is therefore typically wound, and typically the copper wires also have a flattened cross-section, which limits the number of windings per phase and consequently the attainable magnetic saturation. Moreover, if the stator bearing face is damaged, the current-carrying winding can be directly exposed and damaged. Occupational safety aspects play an additional role.

To circumvent the unavoidable disadvantages of a gap winding, i.e., the large magnetic reluctance in the gap region and the limited magnetic field intensity attainable because of the limited maximum number of windings, the attempt has been made to place the winding, at least in the bearing region, in slots of the stator core. However, this leads to significant localized heating, especially of the parts of the rotor that conduct the magnetic flux. The consequence of this heating is thermal strain resulting from differing coefficients of thermal expansion of the rotor components, and deformation of the bearing face, which is especially critical at the relatively small widths typical across the air gap between the bearing faces, normally in the range of hundredths of a millimeter. Enlarging the gap, required in such cases to avoid damage to the bearing face, leads to a marked increase in air space and hence energy consumption. If drive magnets are used in the rotor of a brushless direct current motor, then over a relatively long period of time the heating which occurs can cause temperature-dictated reversible or nonreversible demagnetization, or detachment of the composite material of the powdered magnetic composition of the magnets. It must be remembered that as a rule the magnets are embedded in carbon fibers, which are incapable of dissipating the heat buildup because of their poor thermal conductivity.

SUMMARY OF THE INVENTION

It is therefore an object of the present invention to provide an improved single-motor drive for a shaftless spinning rotor of an open-end spinning machine which achieves an enhanced transfer of power and improved running properties.

According to the invention, this object is attained by providing an improved form of stator for use in a rotor assembly for an open-end spinning machine wherein the rotor assembly comprises an axial field motor having a rotor and a stator with the rotor defining an interior spinning chamber and an outward bearing face and the stator having a bearing face disposed opposite the bearing face of the rotor. Basically, means are provided for producing a combined magnetic and gas bearing for supporting the rotor at a spacing relative to the stator defining an air gap, the bearing means including means for producing a first field of magnetic flux for orienting and maintaining a rotational axis of the rotor in a stationary disposition and means for producing a second field of magnetic flux for driving rotation of the rotor about the axis.

According to the present invention, the stator is formed with an annular configuration and comprises a winding formed in segments arranged symmetrically about the axis of rotation of the rotor for generating the second field of magnetic flux for driving the rotor. The winding segments extend through channels that extend substantially radially with respect to the annular stator and are enclosed over at least a portion of their length by magnetically conductive material. As used herein, references that the channels extend "substantially" radially is intended to mean, and to encompass within the scope of the invention, channels that may not extend exactly on a radius toward the axis of rotation of the rotor but nevertheless depart from the radius by only a slight deviation.

The invention is based on the discovery that, in addition to a fundamental wave of magnetic flux revolving synchronously with the rotor, harmonics occur that travel in the same direction as, but with a decreasing angular speed or an opposite direction, compared with the fundamental wave, and that accordingly have an essentially significant relative speed with respect to the rotor, with the consequence being heating from eddy currents. Since eddy current losses increase with the square of the frequency, the eddy currents, at the high frequencies attendant to the high rpms typical of spinning rotors, are of such magnitude as to markedly affect heat development.

In the form of stator winding described above, i.e., wherein the winding is placed in slots of the stator core, the specific current density is concentrated at the slot openings. As a consequence, the magnetomotive force through the air gap of the magnetic/gas bearing has the character of a stairstep function with sharp edges. Depending on the slot arrangement, the permeance of the air gap also changes abruptly in the region of the channel openings, which causes the development of the aforementioned harmonics, with high frequencies and amplitudes. The consequence is the rapid magnetic reversal of the rotor yoke and magnets and also of nonmagnetic electrically conductive parts of the rotor, causing power losses and the aforementioned heating.

Embodying both the stator core and the stator winding in accordance with the present invention diminishes abrupt changes in magnetomotive force and marked changes in stator permeance in the region of the air gap, and greatly reduces the development of heat, which makes the bearing face of the stator substantially easier to machine and keep planar. The thermal strains that would ensue from differing coefficients of heat expansion do not occur. Because of the diminishment of the problems of deformation of the bearing face, the effective air gap can be kept smaller, in turn saving compressed air needed to establish the air gap and hence saving energy. Moreover, because of the resultant lower magnetic reluctance of the air gap, smaller and lighter weight drive magnets can be used which make the problems of rotor strength less critical.

The thickness of the magnetically conductive material between the channels and the bearing face (i.e., the height of the land or bridging portion between the channels) should be chosen to be sufficiently slight that magnetic saturation is achieved very rapidly, and the flux and hence power losses are as small as possible. The lower limit for the land height is determined for reasons of mechanical stability and based on a minimum magnitude of the magnetic flux, to enable the stairstep function of the magnetomotive force or permeability to be adequately smoothed. By comparison, on the side of the channels opposite the land that forms part of the bearing face, a yoke for developing the primary magnetic flux should be dimensioned such that the ratio between the main flux and the stray flux is at least 10:1, which is approximately equivalent to the ratio between the yoke height and the land height.

According to another aspect of the present invention, the stator bearing face is no longer covered by a potting or sealing compound that covers the gap winding but rather is formed by the solid stator core itself. As a result, it is also possible to make the stator bearing face wear-resistant by coating it or chemically treating it. This may be significant if the rotor comes to be seated on the stator bearing face while still rotating at a relatively high speed, for instance, in the event the bearing gas should fail.

Heating of the rotor is especially high in the peripheral region, particularly because of the increasing relative circumferential speeds of the two bearing faces as the spacing from the rotary axis increases, and the attendant increases in air friction. Reducing the generation of heat resulting from the eddy currents caused by the associated harmonics is therefore especially significant in this peripheral region. Moreover, as a result of the partial nonclosure of the channels on the bearing side in the internal region of the stator, the production of a stray flux in the region of the lands can be minimized, while rotor heating in this region has no significant negative influence.

Assembling the stator from multiple parts has the main advantage that introduction of the windings from the open side of the channel can be done substantially more easily. Alternatively, the possibility also exists of applying a toroidal winding to the main yoke of the stator, with the individual winding components being covered by the initially open channels when the stator is assembled.

It is also preferred that the stator core be formed of multiple component parts, which also enables making the stator core from different materials. The use of a powdered magnetic material bound to insulating material not only has the advantage that it can be produced as a molded part with little effort and shaped optimally in view of the required properties for use, it also has the advantage that eddy current losses can be minimized, especially such losses caused by the stray flux in the region of the lands that cover the channels toward the bearing side. This is due to the fact that the powdered magnetically conductive particles are insulated from one another and consequently reduce the eddy currents. Additionally, the soft magnetic laminated material used for this part of the stator provides good magnetic conductivity because of its slight magnetic reluctance so as to advantageously conduct the main flux by the yoke remote from the bearing face of the stator. However, since the shape of the molded part toward the bearing face can be optimally adapted to the magnetic flux, the magnetic reluctance in this part can also be limited sufficiently that the losses dictated by the lower permeance can be minimized. Thus, the ultimate effect is that the magnetomotive force required for operation of the axial field motor can be limited, which simultaneously leads to a decrease in copper, or $I^2R$, losses.

However, the possibility exists of also using a powdered magnetic material bound to insulation material to make the part of the stator core that forms a magnetically conductive yoke disposed remote from the bearing face. In this case, this yoke would have to be somewhat oversized, compared with a part made of laminated material, to compensate for the lower permeance in the yoke. At the same time, because of the virtually arbitrary shaping enabled by this material, the possibility would exist of suitably rounding off the yoke in the lower part, so as to reduce the $I^2R$ losses as well. This option of arbitrary shaping is severely limited in a laminate whose laying is produced by winding.

The formation of the stator core of multiple components additionally affords the possibility of mechanically decoupling the stator components from one another. For instance, the part of the stator core toward the bearing face can be elastically suspended relative to the other stator parts or to the motor housing, which improves the anti-vibration performance of the motor by reducing the amplitude of any possible rotor vibration, because the mass of the part that receives the vibrational energy from the rotor is lower. This mechanical decoupling is also possible in a simple case wherein an advantageously magnetically conductive elastic layer is provided between the stator parts that decouples the two stator core parts mechanically from one another without significant magnetic losses. The elastic layer simultaneously has a damping effect.

The embodiment of the stator in accordance with the present invention also includes the possibility of disposing the windings in different planes, each of which leads to a tangential annular flow in the yoke in accordance with the drive rotation, or to an axial flow that revolves in the yoke. Both variants of magnetic fluxes are suitable for this drive.

In a stator winding extending parallel to the bearing face, the individual windings can be applied to individual segmented cores, which after being disposed in a ring are covered from both sides so as to form the radial channels according to the invention. The cores, made of a composite material, can be baked together with the winding package. These prefabricated coils are connected to a printed circuit board. In this way, a highly logical manufacture of the entire stator core can be achieved.

The virtually arbitrary shaping already mentioned when a powdered magnetic material bound to insulating material is used also allows the formation of niches at arbitrary points, into which elastic retainers or sensors, for instance, can be inserted. Moreover, it is possible to integrate the gas supply directly with the stator core. It is advantageous in this respect to insert into the stator bearing face small tubes which open into continuous preshaped openings, the tubes being connected to a supply of compressed air. Such gas outlet openings, when located for discharging at a significant distance from the axis of rotation, have the advantage of accomplishing a more secure bearing, especially with relatively large rotors. Moreover, the central opening of the stator core can be kept smaller, which results in a decrease in the magnetic reluctance.

DESCRIPTION OF THE PREFERRED EMBODIMENTS

Figure 7:
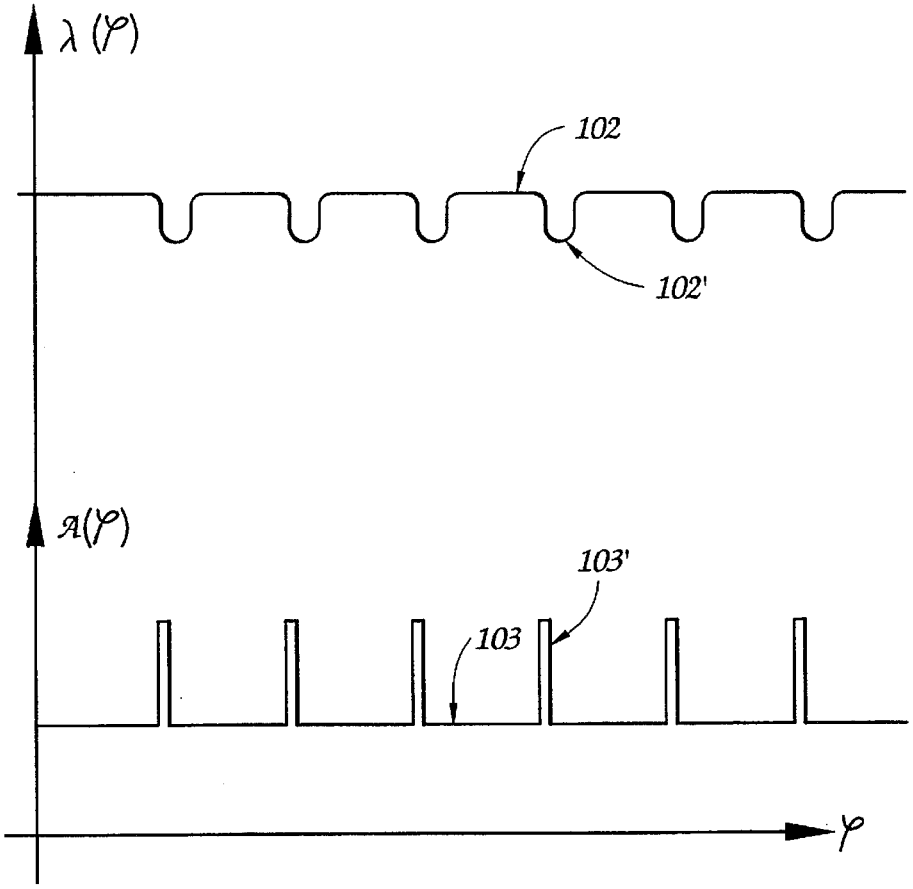
FIG. 7 is a diagram of the permeance and the specific current dependency of the stator as a function of the angle of revolution.

Referring now to the accompanying drawings and initially to FIG. 7, a brief description of the course of the permeance and the specific current density that results if the winding package of the stator core is disposed in slots that are magnetically open toward the bearing side will follow. In this regard, it should be noted that slot closure by magnetically nonconductive material to attain the smoothest possible surface, has no effect on the course of the permeance and specific current density.

Reference numeral 102 indicates the curve of the course of the permeance $\lambda$ as a function of the angle of revolution $\phi$. Reference numeral 102' designates the various dips in permeance that are present in the slot region. The specific current density curve 103 is graduated with sharp edges at each of the same angles $\phi$, because it is concentrated at the slots of the stator core.

The resultant stairstep function of the magnetomotive force causes the development of harmonics with high frequencies and amplitudes, resulting in high losses in the rotor and heating of the rotor, with the further consequences already described.

Figure 1:
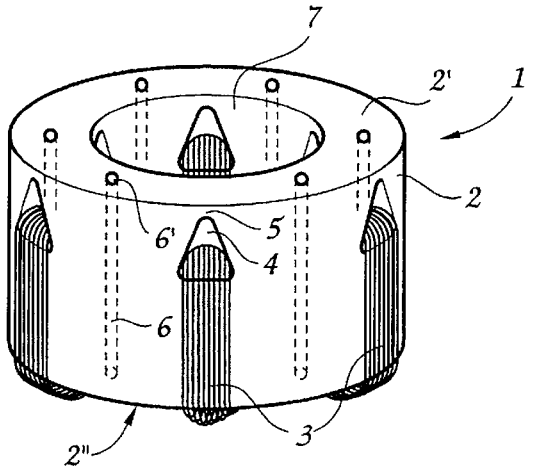
FIG. 1 is a perspective view of a stator with a channel arrangement and windings according to the preferred embodiment of the present invention.

FIG. 1 shows a compact stator 1, whose stator core 2 has radially extending channels 4 each of which are separated from the stator bearing face 2' of the stator core 2 by lands 5 (2' indicates only a portion of the bearing face on the stator, which is supplemented by components located inside the annular stator core 2). A multi-phase winding 3 extends through the channels 4 in the stator core 2. Compared with the known gap winding, this arrangement makes possible both an arbitrary cross-sectional shape of the copper wire that forms the winding and also a multi-layer winding package. In this manner, the magnetic field intensity, which is dependent on the winding number, can be markedly increased, and as a result a correspondingly high motor power can be attained. Thus, the use of the stator is not limited to brushless direct current motors but can readily extend to hysteresis motors or asynchronous motors.

The lands 5, in which a magnetic stray flux occurs, markedly smooth the curves 102 and 103 shown in FIG. 7, which attenuates sharply the harmonics superimposed on the fundamental frequency used for the drive and, in turn, leads directly to a reduction in eddy current losses and in the heating on the rotor. To minimize losses on the stator from the stray flux in the region of the lands 5, the height of these lands 5 should be very slight. The result is relatively rapid magnetic saturation in the region of the lands, whereby the aforementioned stray flux can be markedly limited. The height of the yoke which conducts the main flux, and which extends substantially between the channels 4 and the underside 2" of the stator core opposite the bearing face 2', should be at least ten times the height of the lands 5. Correspondingly, the main flux conducted by the yoke will also be at least ten times the stray flux transmitted by the lands. Depending on requirements, this ratio can be changed, to enable selective variation of the motor properties. In this respect, considerations of the possible harmless rotor heating, in proportion to tolerable losses in the region of the lands of the stator core, play a primary role. In any case, it should be assumed that the stator losses occurring in the regions of the lands are smaller than the loss reduction on the rotor.

It can also be seen in FIG. 1 that gas lines 6 for supplying air or other gas to the bearing gap are extended directly through the stator core 2. These gas lines 6, with their gas outlet openings 6', discharge in the region of the bearing face 2'. The gas lines 6 extend within the stator cross-section between each of the channels 4. The gas lines may either be continuous bores or small tubes inserted into the material of the stator core 2. Such small tubes will be used whenever powdered magnetic material bound to insulating material is employed for the stator core 2. This material has the further principal advantage that the form of the stator, including the channels 4, is easy to manufacture. Corresponding continuous openings can also be made, into which the small tubes that form the gas lines 6 can then be inserted.

If the aforementioned material is employed for the stator core 2, then still further opportunities arise in terms of the shaping of the stator, which will be described in further detail hereinafter in conjunction with FIG. 4.

A cylindrical hollow chamber 7 inside the stator core 2 serves to receive central parts of the stator, particularly means for generating guiding magnetic fields. Further explanation of this will be provided in conjunction with FIG. 6.

Figure 2:
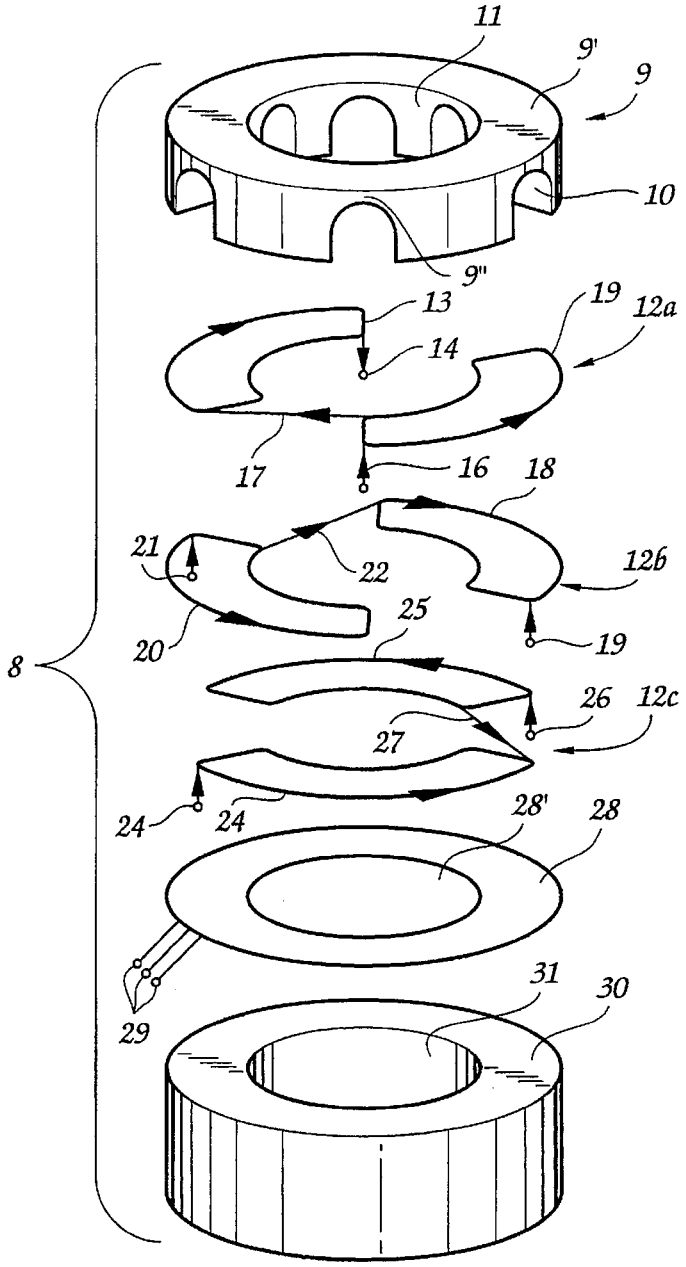
FIG. 2 is an exploded view of an alternate embodiment of a stator according to the present invention, in which the stator comprises multiple prefabricated parts.

In the embodiment of a stator 8 according to the invention shown in FIG. 2, an upper stator part 9 ("upper" stator is not intended to mean that this part must be at the top in the installed state but rather merely refers to how it is shown in the drawings) is provided with radially extending open channels 10. This stator part 9 has a bearing face 9' and lands 9" between the channels 10 and such bearing face 9'. In the middle of the annular upper stator part 9, there is a cylindrical hollow chamber 11, which is in alignment with the cylindrical hollow chamber 31 of a yoke 30 once the stator 8 has been assembled and serves to receive central devices as has already been described in conjunction with FIG. 1.

Hereagain, the yoke 30 has a height corresponding to a multiple of the height of the lands 9", in order to establish the appropriate ratio between the stray flux and the main flux.

In the arrangement shown in FIG. 2, windings 12*a*–12*c* for the three phases of a brushless direct current motor are laid through the channels 10 of the stator part 9 before the yoke 30 is attached. Next, connections 14, 16, 19, 21, 24 and 26 are coupled to corresponding contacts, not shown individually, of a printed circuit board 28 that has an opening 28' coinciding with the cylindrical hollow chamber 31. The line connections 17, 22 and 27 can also be connected in a known manner via this printed circuit board 28. The printed circuit board 28 in turn has connection lines 29 for the three phases, connected to a corresponding energy supply means, e.g., an inverter output, of the axial field motor.

Coils 13 and 19, 18 and 20, and 23 and 25 are disposed parallel to the bearing face 9'. As a result, in contrast to a tangential annular flux of the kind that occurs in the winding arrangement of the first exemplary embodiment of FIG. 1, flux that revolves in the yoke is produced. Both types of flux are suitable for the operation of an axial field motor.

The embodiment of the stator yoke in multiple parts as in FIG. 2 makes it possible to make the upper stator part 9 of powdered magnetic material bound to insulating material, and to make the yoke 30 of a soft magnetic laminated material. As a result, on the one hand, the upper stator part 9 may be formed without problems into virtually any arbitrary shape, while the yoke 30 can advantageously be formed of a lower magnetic reluctance for conducting the main flux. In this respect, it should be assured that the yoke 30 places no limitations on the desired shaping of the components and that its layering can readily be achieved by winding. In the upper stator part 9, the lesser permeance is moreover utilized in order to limit the stray flux still further in the region of the lands 9".

Figure 3:
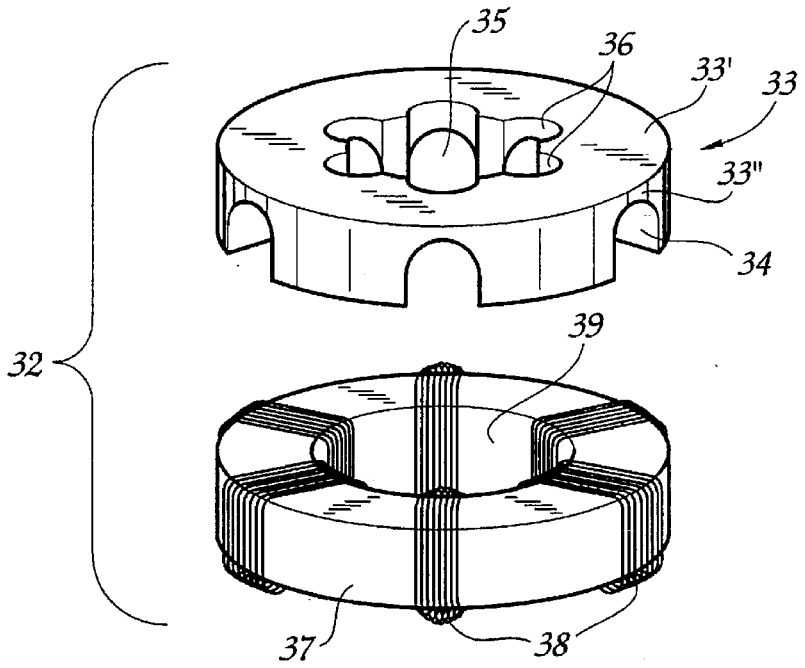
FIG. 3 shows a further embodiment of a stator according to the present invention, with an alternative winding course as compared with FIG. 2.

FIG. 3 shows a further variant of the invention, in which a stator 32 has a winding package analogous to the first embodiment of FIG. 1, the only difference in this embodiment being that the stator is once again formed of two parts, an upper stator part 33 and a yoke 37, for better application of the winding package. However, laying of the winding can be done substantially more simply than in the first example. Unlike the second exemplary embodiment, the winding 38 is applied to the yoke 37, while the upper stator part 33 with its channels 34 fits around the part of the winding package 38 oriented toward the bearing face 33'.

Both the upper stator part 33 and the yoke 37 have concentric cylindrical hollow chambers 35 and 39. However, the cylindrical hollow chamber 35 has a smaller diameter than the cylindrical hollow chamber 39 because no further winding extends within this cylindrical hollow chamber 35 of the upper stator part 33, and consequently the entire diameter of this hollow chamber 35 is available for introducing central parts into the stator 32. Lands 33" once again have only a very slight height compared with the height of the yoke, in order to minimize the stray flux.

The channels 34 of the upper stator part 33, in contrast to the preceding examples, are not closed as far as the cylindrical hollow chamber 35 but instead have land recesses 36 extending from the central hollow chamber 35 outward. These land recesses 36 cause the stray flux that spans the channels 34 to be suppressed in this region.

As a result, the harmonics that create eddy currents and arise through the open slots in this region are admittedly not suppressed. In the region of the rotor near the center, however, this is not problematic, since the relative speed between the rotor and the stator, which is markedly less than in the outer regions, also causes only slight heating from air friction. The more critical outer regions of the rotor where high heating from air friction can occur are not so severely heated by magnetic induction because of the suppression of the harmonics by means of the lands 33". Depending on the rotor size, material, motor type and number of windings on the rotor, the height and also the radial length of the lands 33" can each be optimized. Care must always be taken that the losses be kept slight and that the heating not exceed a critical value.

Figure 4:
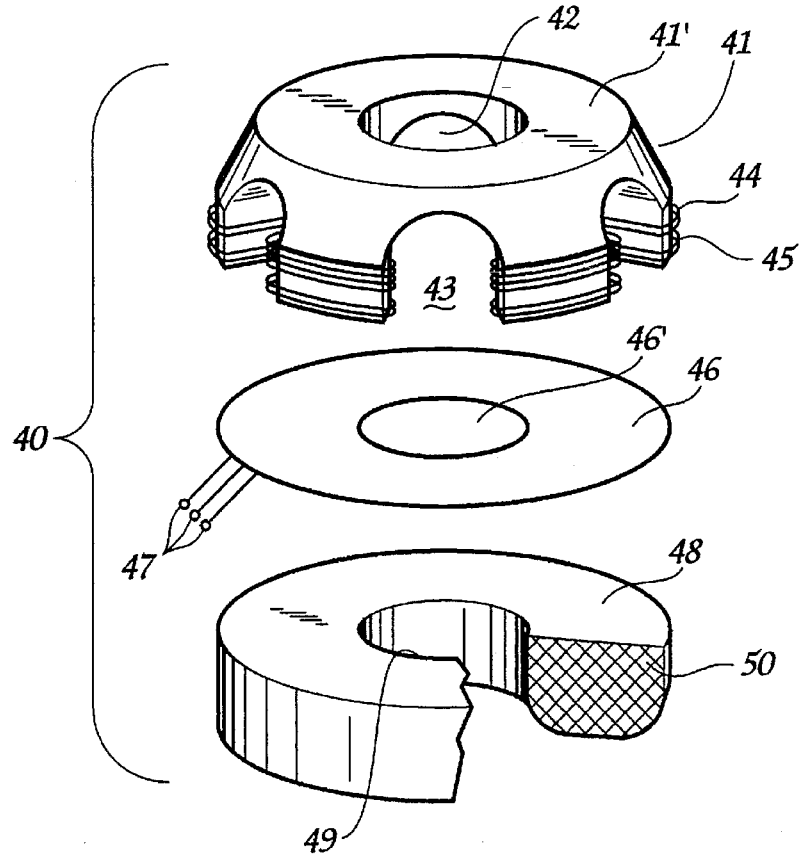
FIG. 4 shows a further alternative of a multiple part stator with a specific shaping according to the present invention.

A fourth exemplary embodiment shown in FIG. 4 is similar to the second exemplary embodiment, in that the winding package is applied to the upper stator part 41 and disposed parallel to the bearing face 41'. However, the individual coils 44 and 45 each extend over only a partition between two adjacent channels 43. In this way, because of the arrangement of these coils, the rotary field can occur in only two planes, compared with three planes in FIG. 2. The coils 44 and 45 are interconnected via a printed circuit board 46, which in turn is connected to an energy supply of the motor via connecting lines 47. The interconnection of the coils 44 and 45 is equivalent to the interconnection shown in FIGS. 5*a*–5*c*, which will be addressed in further detail in connection with the next exemplary embodiment of FIG. 5.

Although the stator 40 of FIG. 4 is embodied in multiple parts, it comprises a powdered magnetic material bound to insulation material not only in its upper stator part 41 but also in its yoke 48. The cross-section 50 of the yoke 48, however, exhibits a pronounced rounding, as compared to the yokes shown in the preceding exemplary embodiments, made possible because of the powdered material utilized, which achieves a reduction in the magnetic reluctance. A further provision for reducing the magnetic reluctance of the material, which has a lower permeance compared with a laminated material, resides in the increase in yoke height. Compared with what is shown in FIG. 4, the height of this yoke can be markedly increased even further. Once again, optimal values with respect to motor running properties can be readily ascertained.

Besides the modified shaping of the yoke 48, it can also be seen in FIG. 4 that the upper stator part 41 likewise differs in shape from the preceding exemplary embodiments. This shaping likewise serves the purpose of optimally guiding the magnetic flux, with the goal of reducing the magnetic reluctance.

When the stator 40 is assembled or installed, care should be taken, as in the previous examples, that the central hollow chambers 42 and 49 and also the annular recess 46' of the printed circuit board 46 be in alignment with one another, to enable the central stator parts to be inserted without problems.

Figure 5:
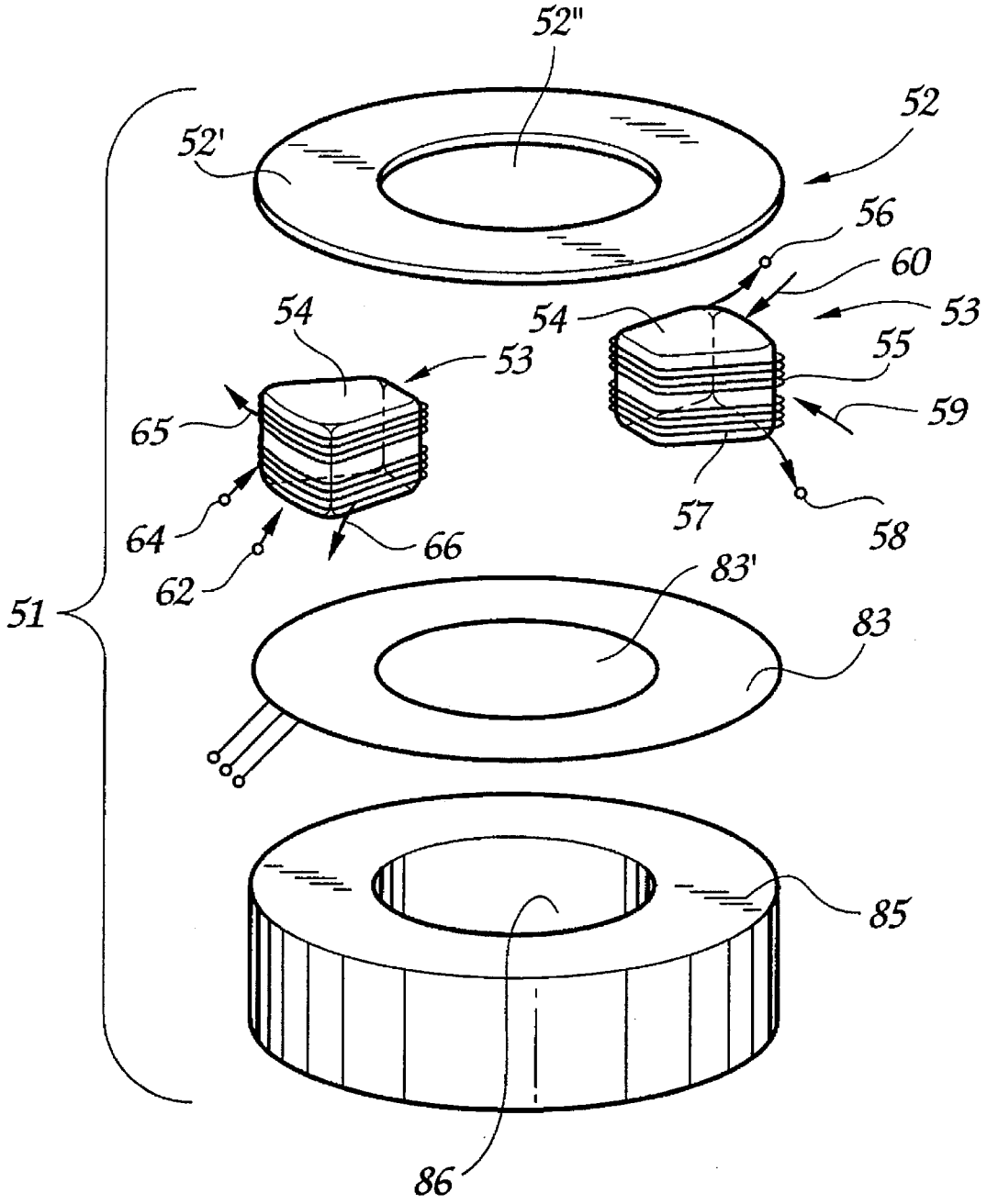
FIG. 5 shows a further embodiment of a stator according to the invention with an arrangement of segmental individual cores.
Figure 5A:
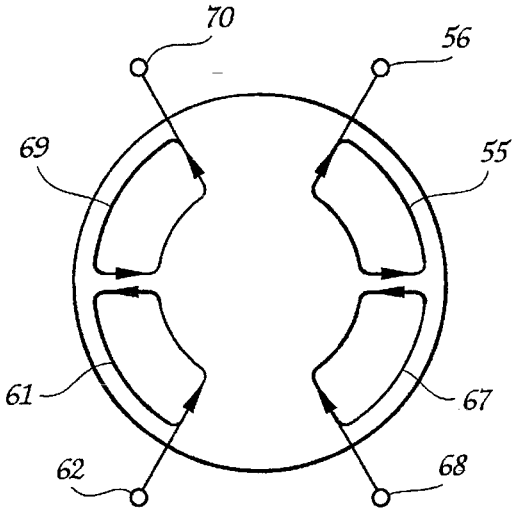
FIGS. 5*a*–5*c* illustrate the multi-phase course of windings for the stator shown in FIG. 5.
Figure 5B:
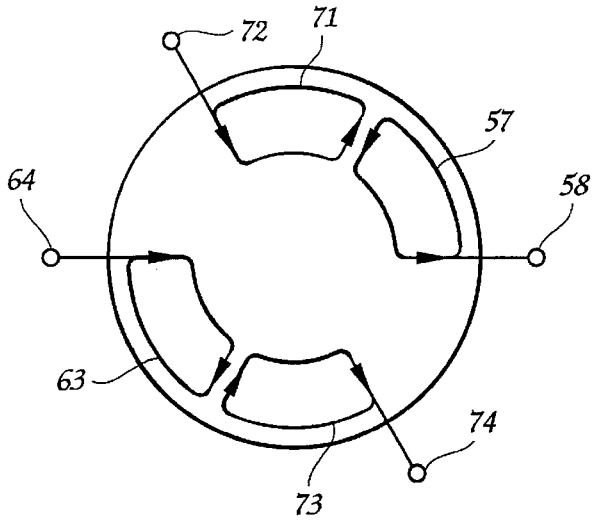
Figure 5C:
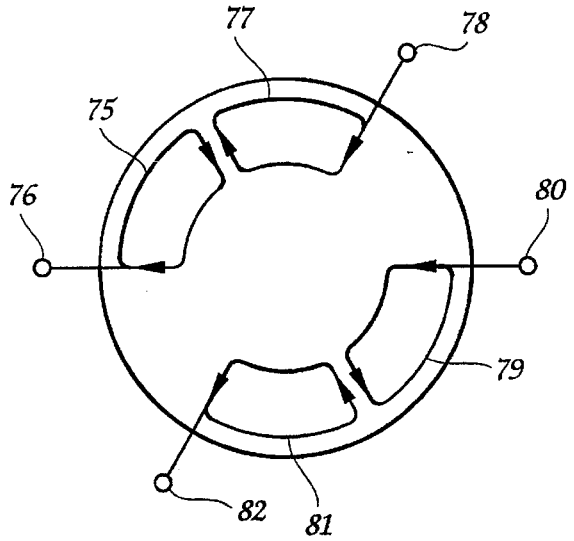

In a further exemplary embodiment shown in FIG. 5, an upper stator part is formed solely by a disk 52 which also forms part of the stator bearing face 52' and defines a central recess 52". The winding package here is applied in six segments 53, which are distributed around the circumference of the stator 51 when the stator is assembled or installed. Of these segments 53, only two are shown in FIG. 5, for the sake of simplicity.

Each of the segments 53 are formed of cores 54 and two opposed coils. The cores 54 are made of a composite material and can be baked together with the coils. These prefabricated coils are interconnected with a printed circuit board 83. By joining the parts of the stator 51 together, the channels, which in the previous exemplary embodiments were prefabricated, are likewise formed between the segments 53 at spacings from one another. The thickness of the disk 52 directly yields the land height, which must be at the appropriate ratio to the height of the yoke 85. The central recess 52" of the disk 52, a central recess 83' of the printed circuit board 83, and a cylindrical hollow chamber 86 of the yoke 85 must be aligned with one another when these parts are joined together, to enable introduction of the central stator parts. The printed circuit board 83 is hereagain provided with connecting lines 84 for the power supply. The disposition of the coils and their wiring can essentially be seen from FIGS. *5a–5c*, in which the three possible phases are shown with phase offsets of 120° each.

If the angle $\phi=0°$ is defined for the phase shown in FIG. *5a*, then the phase in FIG. *5b* is $\phi=120°$, and the phase in FIG. *5c* is $\phi=240°$. The arrows in FIGS. *5a–5c* indicate the current flow direction in each case. In the region of contact between adjacent coils through which current is flowing, it can be seen that the current flow directions are opposed to one another and, as a result, the corresponding magnetic fields cancel one another. The effect is as if adjacent coils through which current flows formed practically a single flow direction; consequently, each pair of adjacent coils can be considered the equivalent of one single coil, which is true for the coil pairs 61,69; 55,67; 57,71; 63,73; 75,77; and 79,81. The connections 56,68,62,70,58,72,64,74, 76,78,80 and 82 are each interconnected with the printed circuit board 83 shown in FIG. 5. The adjacent coils are likewise advantageously interconnected with one another via the printed circuit board 83 in such a way that the current flow direction represented by the directional arrows results.

Figure 6:
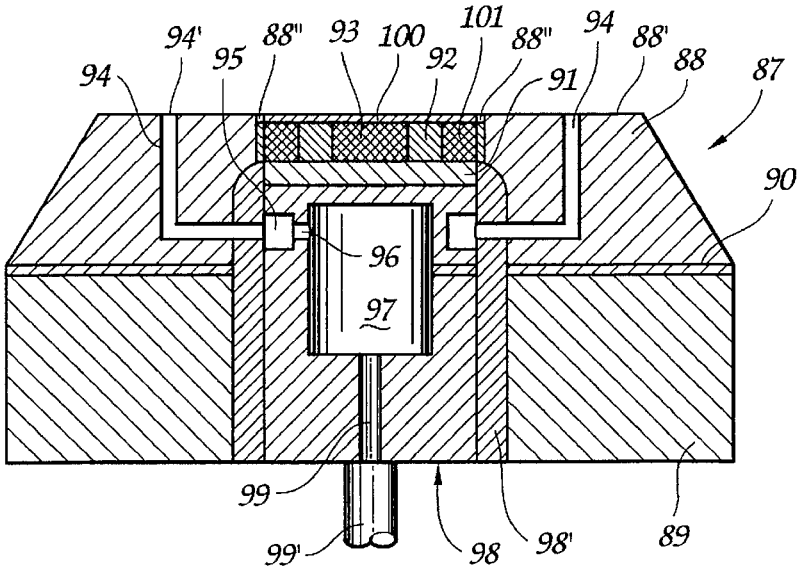
FIG. 6 is a section through a stator according to the present invention showing its central components, including a modified gas supply to the bearing face.

In FIG. 6, one complete stator 87, which also includes the central stator components, is shown. These central components, especially magnets for generating guiding magnetic fields, i.e., retaining and centering magnetic fields, are particularly advantageous to use in such axial field motors in the vicinity of the axis of rotation of the rotor.

An upper stator part 88 and a yoke 89 are joined to one another via an elastic layer 90, and as a result they are mechanically decoupled from one another. Thus, the yoke 89, for example, is permanently attached to the rotor housing, while the upper stator part 88 is merely secured via this elastic layer 90 and consequently can vibrate within predetermined limits independently of the yoke 89 or the rotor housing. As a result, the upper stator part 88, which has a substantially lower mass than a compact stator, has the capability of absorbing rotor vibration, and as a result the running smoothness of the rotor can be improved significantly. This effect is further reinforced since the upper stator part 88 is also mechanically decoupled from the central part 98 by a further elastic layer 88'. It should be noted in this respect as well that the central magnet assembly for generating the guiding magnetic fields should be decoupled from the driving magnetic fields, in order primarily to restrict markedly any influence on the constant magnetic fields of the guiding magnets by the magnetic fields of the outer driving magnets, which have a component that changes both chronologically and spatially. However, details of a magnetic decoupling in the region of the stator have already been described in yet-unpublished German Patent Application P 43 42 582.8 (which corresponds to pending U.S. patent application Ser. No. 08/355,643, filed Dec. 14, 1994), and so further explanation herein should not be necessary.

The section shown in FIG. 6 is placed between two channels within which the stator windings extend. The windings are embedded in a potting or sealing compound 88. The central part 98 of the stator 87 has a central magnet 93 in the region of the bearing face 88', which is surrounded by an annular magnet 101 from which it is spaced apart by an insulating composition 92. Above this magnet assembly, there is a cover layer 100 that is intended to protect the magnets from damage. A yoke 91 is provided on the back side of the magnet assembly and is intended to conduct the guiding magnetic fields. A corresponding magnet assembly may also be present on the opposite bearing side on the rotor. However, since such assemblies are known, from among other sources the International Patent Application WO 92/01096 described above, the illustration and description of the rotor is unnecessary herein.

A gas container 97 for the tank required for the magnet/gas bearing is also present in the central part 98. A connecting line 96 extends from this gas container 97 and discharges into an annular conduit 95. Branching off from this annular conduit are angled gas lines 94, which discharge in the region of the bearing face 88' at uniform spacings from one another and concentrically to the axis of rotation of the rotor. This disposition of gas supply lines outside the central part 98 of the stator 87 on the one hand has the advantage that tumbling motions can be counteracted, particularly in large rotors. Moreover, the central opening in the upper yoke part 88 can be embodied with a smaller diameter, since the gas supply lines no longer need to pass through this opening. This smaller inside diameter of the upper yoke part 88 contributes to reducing the magnetic reluctance. The gas container 97 communicates with a central gas supply (not shown) via a gas supply line 99 and a hose 99' connected to it.

The use of powdered magnetic material bound to insulating material offers not only the advantage of optimal shaping for conducting the magnetic flux and reducing the magnetic reluctance but also the advantage of incorporating retainers, sensors or the like at arbitrary points, because niches suitable for this purpose are provided.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A stator of the type for use in a rotor assembly for an open-end spinning machine wherein the rotor assembly comprises an axial field motor having a rotor and a stator wherein the rotor defines an interior spinning chamber and an outward radial bearing face and the stator includes a radial bearing face disposed axially opposite the bearing face of the rotor, and means for producing a combined magnetic and gas bearing for supporting the rotor at a spacing relative to the stator defined by an intervening air gap, the bearing means including means for producing a first field of magnetic flux for orienting and maintaining a rotational axis of the rotor in a stationary disposition and means for producing a second field of magnetic flux for driving rotation of the rotor about the axis, wherein the stator is formed of an annular configuration and comprises a winding formed in segments arranged symmetrically about the axis of rotation of the rotor for generating the second field of magnetic flux for driving the rotor, the winding segments extending through channels that extend substantially radially with respect to the annular stator and are enclosed over at least a portion of their length by magnetically conductive material.

2. The stator of claim 1, wherein the channels are enclosed in a radially outer portion of their length.

3. The stator of claim 1, and further comprising a stator core assembled from a plurality of axially arranged parts to define the channels to be open in order to introduce the winding and to become enclosed by assembly of the parts.

4. The stator of claim 3, wherein a part of the stator core for defining the channels comprises a powdered magnetic material bound to insulating material.

5. The stator of claim 3, wherein a part of the stator core is disposed axially adjacent the channels and remote from the bearing face forms a magnetically conductive yoke comprising a soft magnetic laminated material.

6. The stator of claim 3, wherein a part of the stator core oriented toward the bearing face of the stator is decoupled mechanically from the remainder of the stator core for vibrational dampening.

7. The stator of claim 6, wherein the decoupled part of the stator core is joined together with the other parts of the stator core via an elastic element.

8. The stator of claim 7, wherein the elastic element is magnetically conductive.

9. The stator of claim 3, wherein a part of the stator core forms the stator bearing face and defines at a side thereof remote from the bearing face open radial slots which are enclosed by the yoke forming part by assembly of the parts.

10. The stator of claim 1, wherein the winding segments of the stator are toroidal in form and are located in planes that are disposed at right angles to the bearing face of the stator.

11. The stator of claim 1, wherein the winding segments of the stator are disposed in a plane that is parallel to the bearing face of the stator.

12. The stator of claim 3, wherein the winding segments are formed about individual core segments disposed in an annular arrangement and axially joined to a bearing ring and to the yoke forming part of the stator for forming the radial channels.

13. The stator of claim 1, wherein the stator defines a plurality of gas supply channels disposed between the channels concentrically about the stator for delivering a gas into the air gap between the rotor and the stator to form the magnet/gas bearing.

14. The stator of claim 13, wherein a part of the stator core forms a magnetically conductive yoke comprising powdered magnetic material bound to insulating material, and the gas supply channels extend through the entire stator core in the form of straight, continuous bores.

* * * * *